United States Patent [19]

Weeger et al.

[11] 4,361,005

[45] Nov. 30, 1982

[54] ASSEMBLY FOR WINDING UP TEXTILE FILAMENTS

[75] Inventors: Hans-Peter Weeger, Hattenofen; Heinrich Herdtle, Ebersbach-Büchenbronn, both of Fed. Rep. of Germany

[73] Assignee: Zinser Textilmaschinen GmbH, Ebersbach, Fed. Rep. of Germany

[21] Appl. No.: 231,142

[22] Filed: Feb. 3, 1981

[30] Foreign Application Priority Data

Feb. 5, 1980 [DE] Fed. Rep. of Germany ..... 3004165

[51] Int. Cl.[3] ..... D01H 7/32; D01H 7/28

[52] U.S. Cl. ..... 57/117

[58] Field of Search ..... 57/115, 117, 279

[56] References Cited

U.S. PATENT DOCUMENTS

| | | | |
|---|---|---|---|
| 57,065 | 8/1866 | Bailey | 57/117 |
| 3,318,079 | 5/1967 | Costner | 57/117 |
| 3,472,013 | 10/1969 | Grishin et al. | 57/117 X |
| 3,559,915 | 2/1971 | Bell | 57/279 X |
| 3,643,415 | 2/1972 | Mackie | 57/117 |

*Primary Examiner*—Donald Watkins
*Attorney, Agent, or Firm*—Karl F. Ross

[57] ABSTRACT

A bobbin rotating on a spindle in order to draw slivers into rovings coacts with a presser foot which is swingable in an eccentric wing of a flyer journaled on a fly frame above the bobbin and coaxial therewith. The inward swing of the presser foot is limited to a distance from the spindle axis which is slightly less than the radius of the bobbin so as to enable an outward camming of that foot, against the force of a biasing spring inside the wing, with the aid of a beveled surface on the presser foot and/or on the bobbin top when the spindle carrying an empty bobbin initially rises relatively to the fly frame.

6 Claims, 5 Drawing Figures

ASSEMBLY FOR WINDING UP TEXTILE FILAMENTS

FIELD OF THE INVENTION

Our present invention relates to a machine for winding up textile filaments, e.g. for drawing slivers into rovings, with the aid of a flyer which is rotatably journaled on a fly frame above a spindle carrying a bobbin onto which the filamentary material is to be wound.

BACKGROUND OF THE INVENTION

Such a flyer is known, for example, from U.S. Pat. No. 3,318,079. As shown there, a presser foot at the lower end of a hollow leg or wing of the flyer is swivelable to guide a textile filament toward a bobbin carried on a spindle which rotates about the common axis of flyer and spindle.

In this type of assembly, contact between the presser foot and bobbin surface is generally maintained by spring pressure, though it has also been proposed to do so by a centrifugal force. The latter arrangement has the drawback that at the beginning of the winding-up operation, when the flyer is practically motionless, there is no substantial pressure holding the filamentary material onto the peripheral surface of the bobbin. Spring-loaded pressure feet, on the other hand, were heretofore mounted in such a way that their free ends stayed clear of an imaginary cylinder, with a radius equal to that of the bobbin, centered on the spindle axis; this was to prevent the presser foot from interfering with an upward movement of the bobbin into the orbit of the flyer during an initial rise of the spindle support relative to the fly frame. Since, however, rotation of the flyer about its axis usually starts up somewhat abruptly, the presser foot is subjected to a centrifugal force tending to swing it away from the bobbin so that the necessary contact pressure may be established only after several spindle rotations.

OBJECT OF THE INVENTION

The object of our present invention, therefore, is to provide an improved assembly of the type referred to which insures immediate entrainment of the filamentary material, such as a sliver, by an empty bobbin coacting with the filament-guiding flyer.

SUMMARY OF THE INVENTION

We realize this object, in accordance with our present invention, by the provision of coacting formations on the presser foot and on the lower extremity of a flyer wing on which that foot is swivelably mounted under spring pressure, these formations limiting the inward swing of the presser foot to a minimum distance of its free end from the spindle axis which is slightly less than the radius of the peripheral bobbin surface whereby that free end initially protrudes somewhat into the aforementioned imaginary cylinder. In order to facilitate the initial rise of the bobbin into the orbit of the flyer, we further provide the bobbin and the free end of the presser foot with surface portions that are cammingly engageable with each other upon such rise whereby the presser foot is swung outward against its spring force to let its free end come to rest against the peripheral bobbin surface.

The cammingly interengageable surface portions may include a radially outwardly bent lug depending from the free presser-foot end, a beveled top of the bobbin, or a combination of the two.

BRIEF DESCRIPTION OF THE DRAWING

The above and other features of our invention will now be described in detail with reference to the accompanying drawing in which.

SPECIFIC DESCRIPTION

Figure 1:
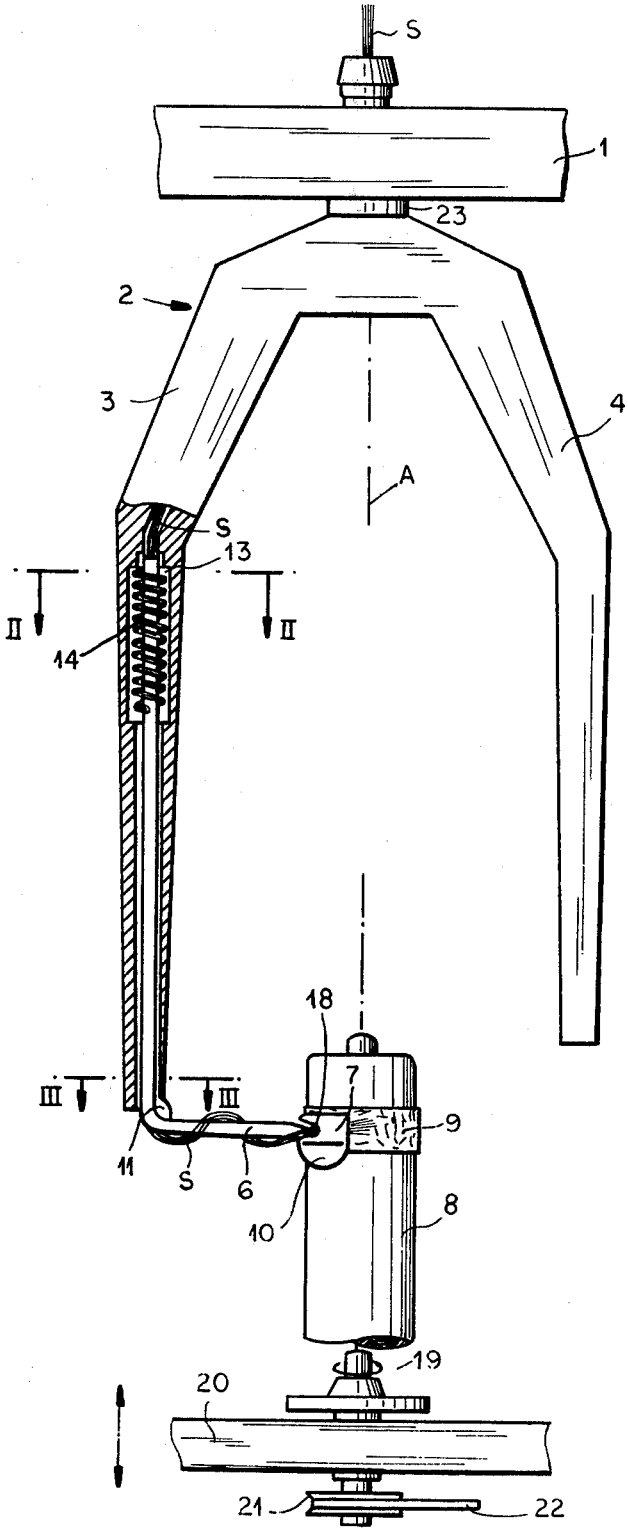
FIG. 1 is a somewhat diagrammatic side-elevational view, partly in section, of an assembly of a flyer and a bobbin-carrying spindle embodying our invention.
Figure 2:
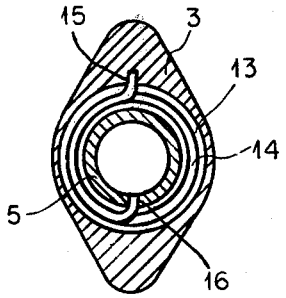
FIGS. 2 and 3 are cross-sectional views of a flyer wing, taken respectively on lines II—II and III—III of FIG. 1.
Figure 3:
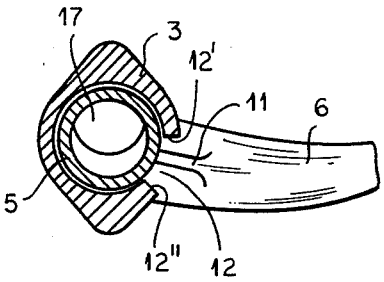
Figure 4:
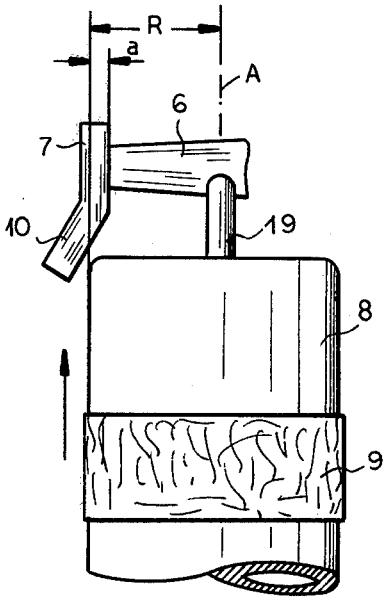
FIG. 4 is an enlarged detail view of parts of a presser foot and a bobbin in a position of initial approach.

In FIGS. 1–4 we have shown a fly frame 1 on which a flyer 2 is journaled for rotation about a generally vertical axis A which is also the axis of rotation of a spindle 19 (partly broken away) carrying an empty bobbin 8 to be loaded with a sliver S. Flyer 2 has a hollow sliver-guiding wing 3 and an opposite, balancing wing 4 depending from a swivel head 23. A substantially L-shaped guide tube swivelably supported by the flyer 2 has a longitudinal leg 5 received in its hollow wing 3 and a shorter transverse leg 6 constituting a presser foot. An annular clearance 13 in wing 3 is occupied by a coil spring 14 surrounding the tubular leg 5; as best seen in FIG. 2, spring 14 has one end 15 anchored to wing 3 and another end 16 anchored to tube 5. A rib 11 on presser foot 6 projects upward into a sectoral gap 12 at the lower extremity of wing 3, this gap being bounded by edges 12' and 12'' (FIG. 3) limiting the swing of guide tube 5, 6. The free end of foot 6 carries a pressure plate 7 which is urged by the spring 14 toward axis A but, in the absence of bobbin 8, is arrested by contact between rib 11 and edge 12' in a position in which plate 7 is separated from axis A by a distance R-a where R is the bobbin radius and a is a small fraction of that radius. Thus, as seen in FIG. 4, plate 7 protrudes in that limiting position by the distance a into an imaginary cylinder of radius R centered on axis A.

Spindle 19 is mounted in the usual manner on a spindle bank 20 and is shown driven from a nonillustrated motor via a pulley 21 and a belt 22. Flyer 2 and spindle 19 are, of course, representative of a large number of such elements respectively carried on frame 1 and spindle bank 20 whose relative vertical motion initially elevates the bobbin 8 into the orbit of flyer 2 and subsequently lets the sliver S be wound on the peripheral bobbin surface in an orderly package. To facilitate such relative motion despite the protrusion of pressure plate 7 into the path of the rising bobbin, plate 7 is shown provided with a depending deflecting lug 10 which is bent radially outward for camming engagement with the slightly rounded upper edge of the bobbin. When the flyer begins to rotate upon initial contact between bobbin 8 and lug 10, the resulting centrifugal force will not move the plate 7 beyond the periphery of bobbin 8 so that spring 14 will keep that plate in contact with the bobbin surface. Sliver S, descending inside leg 5 and exiting therefrom at a port 17 seen in FIG. 3, is led around presser foot 6 and passes through an eye 18 of plate 7 toward the bobbin surface which is shown provided, in a manner known per se, with a strip zone 9 of adhesive or burry character designed to capture the loose end of the sliver at the beginning of the winding phase.

Figure 5:
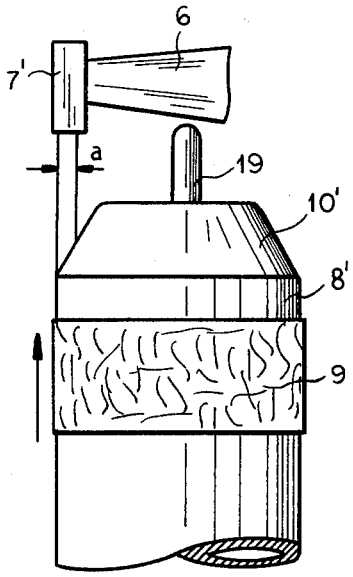
FIG. 5 is a view similar to FIG. 4, illustrating a modification.

As illustrated in FIG. 5, a modified pressure plate 7' without lug 10 may cammingly engage a frustoconical zone 10' of a bobbin 8' when the latter is lifted by its spindle 19 to the level of presser foot 6. In this instance, as in the previous case, a beveled surface portion extends over more than distance a in the radial direction to prevent any interference between the presser foot and the rising bobbin.

The width of gap 12, i.e. the separation of edges 12', 12'' from each other, is of course sufficient to let the presser foot 6 swing out with increasing radius of the filamentary package wound on bobbin 8 or 8'.

We claim:

1. In a machine for winding up textile filaments, comprising a frame with flyers journaled thereon for rotation about generally vertical axes of respective spindles that are rotatably carried on a support vertically movable relatively to said frame, each of said flyers having depending wings provided with a presser foot having a free end for the guidance of filaments to be pressed thereby against a peripheral surface of a rotating bobbin which is carried on the respective spindle and on which such filaments are to be wound, the improvement wherein said presser foot is swivelably mounted on a lower extremity of said wing and is provided with spring means urging the free end thereof toward the respective spindle axis, said extremity and said presser foot being provided with coacting formations limiting an inward swing of said presser foot under the force of said spring means to a minimum distance of said free end from said spindle axis which is slightly less than the radius of said peripheral surface, said free end and said bobbin having surface portions cammingly engageable with each other upon a rise of said support relative to said frame with said free end located at said minimum distance from said spindle axis whereby said presser foot is swung outward to let said free end come to rest against the peripheral surface of said bobbin.

2. A machine as defined in claim 1 wherein said wing is hollow, said presser foot being a transverse leg of a generally L-shaped sliver-guiding tube with a longitudinal leg received in said wing.

3. A machine as defined in claim 2 wherein said spring means comprise a coil spring in an annular clearance between said longitudinal leg and said wing, said coil spring being anchored to said wing and to said longitudinal leg.

4. A machine as defined in claim 2 or 3 wherein said lower extremity is provided with a sectoral gap just above said transverse leg, said coacting formations comprising an edge of said gap and a ridge on said transverse leg rising into said gap.

5. A machine as defined in claim 1, 2 or 3 wherein said cammingly engageable surface portions include a radially outwardly bent lug depending from said free end.

6. A machine as defined in claim 1, 2 or 3 wherein said cammingly engageable surface portions include a beveled top of said bobbin.

* * * * *